United States Patent [19]

Danko

[11] Patent Number: 4,628,189

[45] Date of Patent: Dec. 9, 1986

[54] ELECTRIC RESISTANCE HEATER

[75] Inventor: Michael Danko, Bland County, Va.

[73] Assignee: Emerson Electric Co., St. Louis, Mo.

[21] Appl. No.: 700,116

[22] Filed: Feb. 11, 1985

[51] Int. Cl.[4] ..... H05B 3/06

[52] U.S. Cl. ..... 219/532; 174/138 J; 174/175; 219/542; 219/536; 338/286; 338/304

[58] Field of Search ..... D13/17, 1 B; 174/138 J, 174/138 R, 175; 219/274, 275, 354, 532, 536, 537, 542, 552; 338/286, 304

[56] References Cited

U.S. PATENT DOCUMENTS

| | | | |
|---|---|---|---|
| D. 248,464 | 7/1978 | Moore | D13/17 |
| D. 248,641 | 7/1978 | Thweatt, Jr. | D13/17 |
| D. 248,642 | 7/1978 | Thweatt, Jr. | D13/17 |
| D. 248,643 | 7/1978 | Thweatt, Jr. | D13/17 |
| D. 248,943 | 8/1978 | King | D13/18 |
| D. 250,644 | 12/1978 | Thweatt, Jr. | D13/17 |
| D. 253,171 | 10/1979 | Harris et al. | D13/17 |
| D. 262,285 | 12/1981 | Janning | D13/18 |
| 1,844,678 | 2/1932 | Pickup | 219/532 |
| 2,921,172 | 1/1960 | Hackman | 219/532 |
| 3,016,441 | 1/1962 | Hackman et al. | 219/532 |
| 3,358,074 | 12/1967 | Himes | 174/138 J |
| 3,641,312 | 2/1972 | Ammerman et al. | 219/532 |
| 3,697,727 | 10/1972 | Neuman et al. | 219/532 |
| 3,770,939 | 11/1973 | Kokjohn | 219/532 |
| 3,846,619 | 11/1974 | Wightman et al. | 219/532 |
| 3,883,721 | 5/1975 | Paulson et al. | 219/532 |
| 3,890,487 | 6/1975 | Wightman et al. | 219/532 |
| 3,943,333 | 3/1976 | Kokjohn et al. | 219/532 |
| 4,144,445 | 3/1979 | Thweatt, Jr. | 219/532 |
| 4,250,399 | 2/1981 | King | 219/532 |
| 4,268,742 | 5/1981 | Cottrell et al. | 219/532 |
| 4,363,959 | 12/1982 | Cottrell et al. | 219/532 |
| 4,458,141 | 7/1984 | Howard et al. | 219/532 |
| 4,472,624 | 9/1984 | Janning | 219/532 |
| 4,481,411 | 11/1984 | Roth | 219/532 |
| 4,531,017 | 7/1985 | Sherrill | 174/138 J |

*Primary Examiner*—C. L. Albritton

*Attorney, Agent, or Firm*—Polster, Polster and Lucchesi

[57] ABSTRACT

An insulator for a coil-type electric resistance heater is disclosed in which the insulator has inclined side faces forming the outer end of the insulator angling inwardly toward one another with side notches in the insulator at the base of the inclined side faces and a central notch in the outer end of the insulator between the two inclined side faces. The distance between the center notch and the outer ends of the inclined side faces is less than the spacing of the adjacent convolutions of the heater element coils so that upon aligning one convolution with the central notch and upon moving the insulator inwardly toward the axis of the coil, the one convolution will be received in the center notch and the adjacent convolutions will be wedgingly engaged by the side faces of the insulator so as to resiliently spread the convolutions such that the adjacent convolutions will snap into the side notches.

A method of installing an electrical resistance heater on a plurality of insulators is disclosed.

6 Claims, 10 Drawing Figures

ELECTRIC RESISTANCE HEATER

BACKGROUND OF THE INVENTION

This invention relates to electrical resistance heaters, and more particularly to such heaters in which the heating element is formed of electrical resistance heating wire, of nichrome or the like, and even more particularly in which the heating element is formed in a helical coil and in which the heating element is supported on a frame or the like by means of ceramic-like insulators. Such heating elements find a wide range of applications, such as in electric clothes dryers, resistance heating systems for residential and in commercial heating and ventilating systems.

Heretofore, electrical resistance heating elements, such as described above, were mounted on a metal frame and were carried by ceramic electrical insulators thereby to electrically isolate the heating element from the frame. As shown in U.S. Pat. No. 3,697,727, these insulators were typically hollow collars or bushings through which the coiled electric resistance heating element was inserted However, it has been found that these ring-like insulator collars were not entirely desirable because air flow through the collars was somewhat limited and thus increased significantly the surface temperature of the electric resistance heating element within the collar several hundred degrees Fahrenheit above the temperature of the heating element exposed to air flow thereover. This increased temperature of the heating element within the collars deleteriously affected service life of the heating element because of increased rates of oxidation of the heating element wire. Further, the insulator bushings did not securely fasten or anchor the heating coils and, during repeated firing and unfiring of the heating element, the coils would slide on the collars and abrade the heating element, weakening it and leading to reduced service life of the heating coil.

Still further, the requirement of having to use solid circular insulator collars required more time to assemble the heating element because the insulator collars had to be threaded onto the continuous length of the heating element.

Additionally, as is illustrated in the above-noted U.S. Pat. No. 3,697,727, the heating element was typically of helical coil construction from one end to the other with the heating coil being formed in a generally serpentine arrangement with the parallel portions of the heating element constituting runs and with the portions of the heating element interconnecting adjacent runs being referred to as turnarounds. Typically, such a continuous, coiled heating element is installed in an air duct or the like through which air may be forceably circulated thereby to transfer heat from the heating element to the air flowing therethrough. This compact, serpentine design of the heating element is desirable because it maximizes circulation of the air over the heating element and thus enhances heat transfer to the air. However, the lengths of the heating element runs which are freely supported between the insulators tend to lose strength when heated or fired and, over time, the weight of the coiled helical heating element hanging between the insulators could cause the heating elements to sag. This sagging is particularly undesirable because if the heating element sags beyond a certain degree because the heating element may break or may contact the sidewalls of the duct within which it is installed or the frame carrying the heating element thus shorting out the heating element. Therefore, there has been a longstanding need to support the heating element so as to eliminate or lessen the tendency of the unsupported lengths of a coiled heating element to sag.

The coassigned U.S. Pat. No. 4,472 624 represents an important step in the art in that the insulator disclosed therein securely engaged three adjacent convolutions of the heating coil with the center of these convolutions displaced in lateral direction from the other two relative to the longitudinal centerline of the coil. This positively held the coil from moving relative to the insulator and minimized sagging of the coil. However, insertion of the coils on the insulators was a time-consuming task that required hand labor with its attendant high labor costs.

Reference made to such U.S. Pat. Nos. as 1,844,678, 2,921,172, 3,016,441, 3,358,074, 3,641,312, 3,770,939, 3,846,619, 3,890,487 and U.S. Des. Pat. No. 262,285 for prior art references in the same general field as the present invention.

SUMMARY OF THE INVENTION

Among the several objects and features of this invention may be noted the provision of an insulator for an electrical resistance heater in which the insulators contact three adjacent convolutions of the helical coiled heating element at only localized points therearound thereby to permit air circulation to flow freely over the convolutions supported by the insulators;

The provision of such an insulator in which the heating element may be formed to its desired configuration and readily applied to the insulators already installed on the frame for the heating element;

The provision of such an insulator in which the heating coil may be readily installed on the heating coil in such manner as to effect substantial labor savings in assembly of the heating element and, at least in certain instances, to facilitate the automated installation of the heating coils on the insulators;

The provision of such an insulator which minimizes stretching of the heating element coil as the latter is installed on the insulators, and yet which insures that the heating coil is locked in place on the insulator;

The provision of such an insulator which permits the ready field repair of the heating element, even after the heating element has been fired, without undue breakage of the heating element;

The provision of such an insulator which supports the runs of the heating element in such manner as to lessen the tendency of the heating element to sag; and The provision of such an insulator which is of simple and rugged construction, which is easy to assembly, which requires less labor to manufacture, which has a longer service life, and which is more readily field repairable than prior heating elements.

Other objects and features of this invention will be in part pointed out and in part apparent hereinafter.

Briefly stated, an electrical resistance heater typically has an elongate wire heating element of generally helical coil shape. The helical coil has a coil axis and a plurality of convolutions spaced at substantially equal intervals along the coil axis. The heater further has a frame and a plurality of electrical insulators for supporting the heating element on the frame. Each of the insulators has a unitary body of a suitable electrical insulative material. The body has a first and a second side facing in generally opposite directions. The insulator includes means for mounting the insulator body with respect to the frame such that the first and second sides are generally in line with the coil axis. The insulator body further has a side notch in each of its above-mentioned first and second sides, with each of the side notches extending generally inwardly toward the center of the insulator body. Further, at least a portion of the first and second sides of the insulator body is spaced outwardly from the insulator body mounting means, and these portions angle inwardly so as to constitute a pair of outer faces converging toward one another. The insulator further has an outer end between the angled outer faces, with the outer end of the insulator body having a center notch therein extending inwardly toward the mounting means. The ends of the insulator body between the outer ends of each of the angled outer faces and the outer end of its adjacent center notch face has a width less than the axial spacing between the convolutions of the coil along the coil. This permits the ends of the insulator and the coil heating element to be assembled by disposing the insulator relative to the coil with one convolution substantially in register with the center notch, and with adjacent convolutions on opposite sides of this one convolution being engageable with a respective angled outer face of the insulator body. By moving the insulator and coil toward one another, the one convolution is received within the center notch, and the adjacent convolutions are wedgingly spread outwardly away from the one convolution generally along the coil axis by engagement with their respective angled outer faces of the insulator body until the adjacent convolutions are in register with and snap into their respective side notches. In this manner, the side notches positively hold their respective coil convolutions against movement toward and away from the insulator body and such that the center notch holds its respective coil convolutions against movement along the coil axis.

Further, this invention includes a method of installing such a coil-type heating element on an insulator, generally as above-described, in which one heating element convolution is inserted into the center notch of the insulator, and in which adjacent convolutions are brought into contact with the angled outer faces of the insulator body. Then, the heating element coil is shoved onto the insulator such that the outer angled faces of the insulator wedgingly spread the adjacent convolutions outwardly relative to the one convolution received in the center notch until such time as the adjacent convolutions are received in the side notches such that the side notches prevent movement of the heating coil toward and away from the insulator, and such that the convolution received in the center notch permits movement of the heating element in the direction of the axis of the heating element coil.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
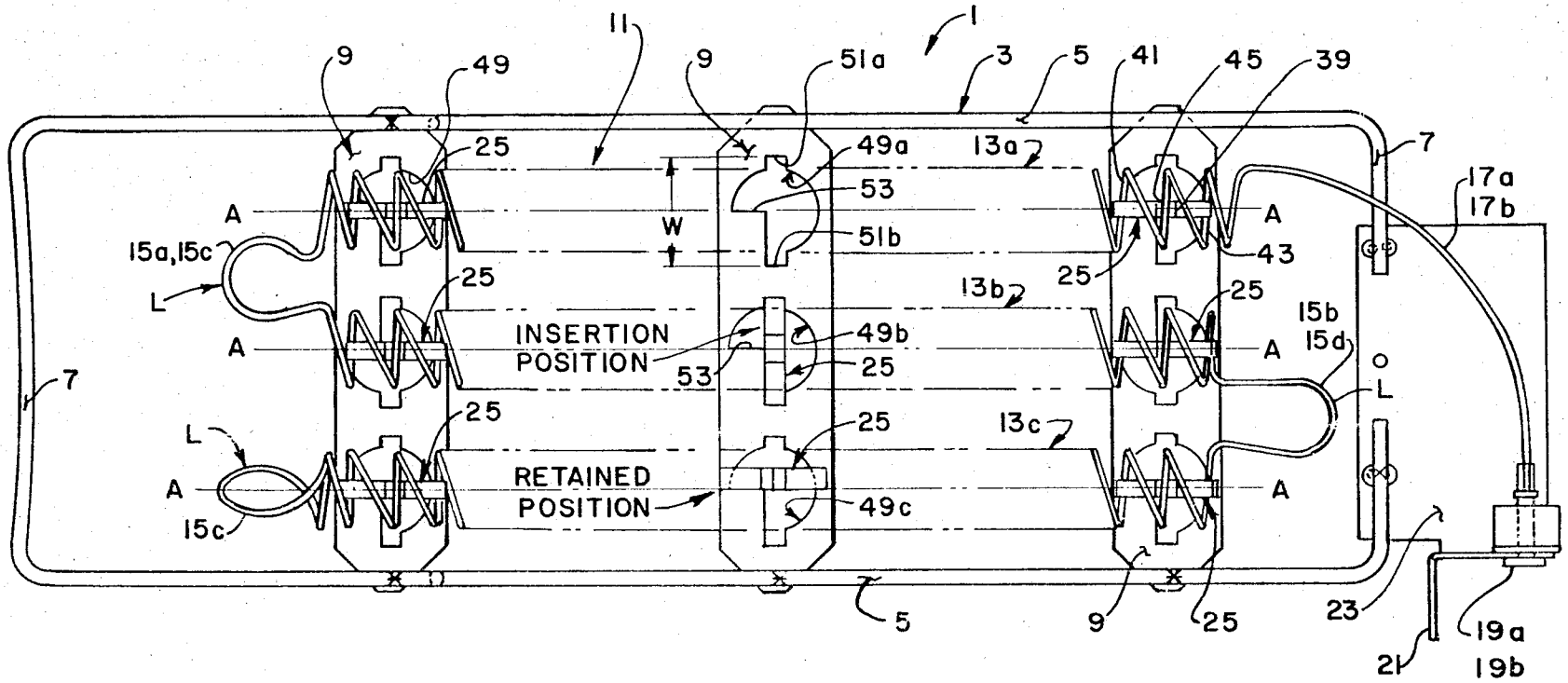
FIG. 1 is a top plan view of an electrical resistance heater assembly having a plurality of runs of a coiled heating element supported on a frame by a plurality of insulators of the present invention.

Referring now to the drawings, an electrical resistance heater is generally indicated in its entirety by reference character 1. Heater 1 includes a frame, as generally indicated at 3, having side bars or rods 5 extending longitudinally of the frame and having ends 7 at each end thereof. As shown, frame 3 is constituted by a one-piece, formed rod and the frame has three support bars or plates 9 extending transversely between side members 5 for supporting the heating element in a manner as will appear. Each of the support bars is of formed sheet metal and is secured (e.g., welded) at its ends to side rods 5.

As generally indicated at 11, a heating element is mounted on the support bars 9 of frame 3 by means of insulators of the present invention (a description of which will appear in detail hereinafter). As is typical, heating element 11 is a continuous length of suitable electrical resistance heating wire, such as Nichrome or the like, and such as is well known to those skilled in the art. As shown, heating element 11 has a plurality (e.g., six) of heating element runs **13*a*–13*f* extending generally parallel to one another with three of the runs 13*a*–13*c* being located on one side of support bars 9 and with the other three runs 13*d*–13*f* being located on the other side of the support bars. As shown, each of the runs is constituted by a longitudinal helical coil of the electrical resistance heating wire with the coil having a multiplicity of generally uniformly spaced convolutions and having center helical coil axis, as indicated by A—A in FIGS. 1, 2, and 5**.

Each of the adjacent runs **13*a*–13*f* of the heating element 11 are electrically connected in series to an adjacent run of the heating element by means of a so-called turnaround, as indicated at 15*a*–15*e*. More specifically, it will be noted that each of the turnarounds is not of helical coil construction, but rather each of the turnarounds 15*a*–15*e* has a defined length of heating element wire therein and each of the turnarounds includes a partially closed loop, as generally indicated at L, electrically connecting the end of one heating element run (e.g., run 13*a*) with the end of the next adjacent run (e.g., run 13*b*) in series therewith thereby to provide electrical continuity from one end of heating element 11** to the other.

In addition to the helical coiled runs **13*a*–13*b* and the looped end turns 15*a*–15*f*, as above described, heating element 11 includes a pair of leads, as indicated at 17*a*, 17*b*, integral with the heating element and constituting the ends of heating element 11 with these leads being electrically connected to respective electrical terminals 19***a*, 19*b*. Those skilled in the art will recognize that the terminals 19*a*, 19*b* may be connected to a source of electrical power for energization of heating element 11 in the conventional manner. Further, frame 3 for heating element 1 comprises a terminal support bracket 21. The support bracket is carried by a plate 23 which is secured to one end 7 of frame 3. Within the broader aspects of this invention, heater frames of other configurations may be used.

As heretofore mentioned, runs 13*a*–13*f* of heating element 11 are supported on electrical and thermal insulators, each of which is generally indicated at 25, thereby to hold the heating element 11 clear of frame 3 and to support the heating element during energization. As shown best in FIG. 2, each insulator 25 is carried by a respective support bar 9 and has the provision on both its upper and lower faces (as viewed in FIG. 2) of securing and supporting a respective run of heating element 11 in such manner as to maximize heat transfer from the convolutions of the heating element engageable with the insulator thereby to minimize the operating temperature of the portions of the heating coil supported by the insulator and also so as to support the heating coil in such manner as to minimize sag of the helical coil heating element extending between the insulators.

Figure 5:
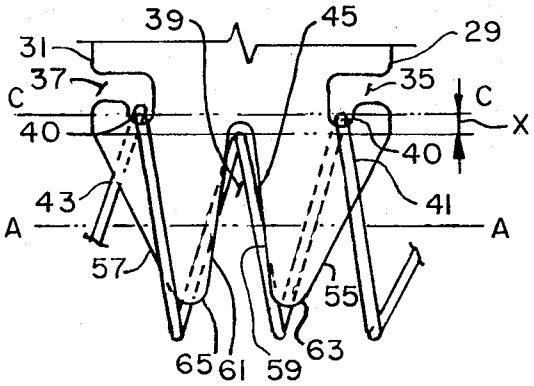
FIG. 5 is an enlarged view of the lower portion of the insulator shown in FIG. 3.
Figure 3:
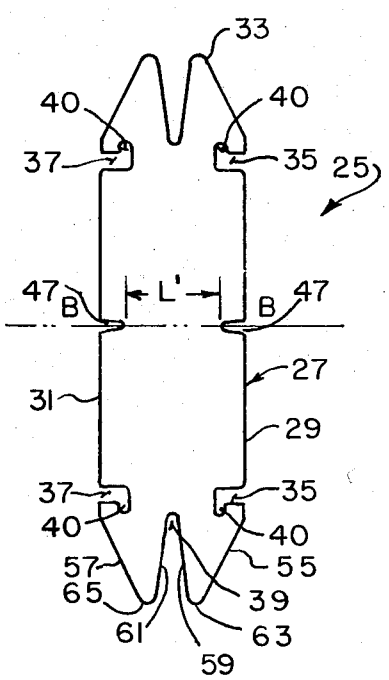
FIG. 3 is a front elevational view of a first embodiment of an insulator of the present invention.

As shown in FIG. 3, a first embodiment of insulator 25 is shown to be generally symmetrical about an axis, or plane, as indicated by B—B and thus only the lower portion of the insulator, as shown in FIG. 5, will be described in detail. However, those skilled in the art will recognize that the bottom portion of the insulator is essentially identical and operates to support its respective heating element run in the same manner as will hereinafter be described.

As is conventional, insulator 25 is preferably made of a ceramic-like material, for example cordierite or steatite, so as to electrically insulate heating element 11 from frame 3 and also so as to thermally insulate the heating element and to prevent undue conduction of heat away from the portions of the heating element in contact with the insulator.

Figure 4:
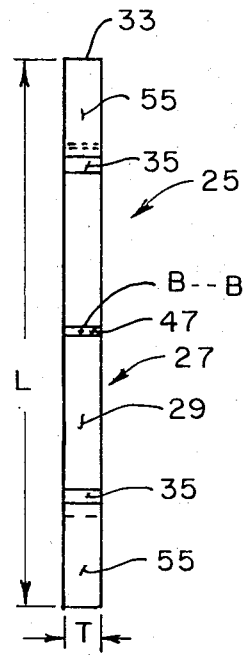
FIG. 4 is a side elevational view of the insulator of FIG. 3.

Insulator 25 is constituted by a body 27 of the steatite material (or of other ceramic electrical insulative material) with the body having a width or thickness T, as shown in FIG. 4, and having an overall length, as indicated by dimension L in FIG. 4. As shown in FIG. 3, insulator 25 has a first side 29 (i.e., the right side as shown in FIG. 3) and a second side, as indicated at 31. Further, the insulator has a top and a bottom side or end 33 intermediate the first and second sides. In accordance with this invention, first side 29 has a blind notch, as indicated at 35, provided therein and side 31 has a similar notch 37 therein. Further, the upper or lower ends 33 of the insulator have an intermediate or center notch 39 therein. The width of notches 35 and 37 is somewhat wider than the thickness of electrical resistance heating wire 11. As shown in FIGS. 3 and 5, the inner ends 40 of each of the side notches 35 and 37 are generally perpendicularly offset from the generally horizontal entrance portions of the side notches and end portions 40 are formed in a radius so as to engage and support only a segment of a respective convolution 41 or 43 of a respective run 13*a*–13*f* of heating element 11 in engagement with the insulator.

As is best shown in FIG. 5, the portion of the convolutions 41 and 43 of the heating element runs received in notches 35 and 37 are generally coplanar, as indicated by axis C—C. In one embodiment of the insulator of this invention, the bottom of center notch 39 is preferably (but not necessarily) spaced outwardly of axis C—C of the ends of notches 35 and 37 by an offset distance, as indicated at X in FIG. 5. Thus, upon installing a respective heating element run 13*a*–13*f* on a respective insulator 25, in a manner as will be hereinafter described, a first convolution, as indicated at 45, is placed in its respective center notch 39 such that the heating coil is bent along its helical axis A—A with the bottoms of the next adjacent intermediate convolutions 41 and 43 received in their respective side notches 35 and 37. Thus, the bottoms of convolutions 41 and 43 are resiliently sprung downwardly (as shown in FIG. 5) and are restrained against further downward movement by the closed ends 40 of the inclined notches 35 and 37. However, because of the offset distance X between the inner ends 40 of the blind notches 35 and 37 relative to the bottom of intermediate slot 39, convolution 45 is displaced outwardly away from the center axis A—A of the helical heating coil by the offset difference X such that a resilient restraining force is applied to the helical coil as it extends from one insulator 25 to the next adjacent heating element. This resilient force tends to hold the coiled heating element in place on insulators 25 regardless of the orientation of the heating element or the insulators. Those skilled in the art will appreciate that the offset of intermediate convolution 45 due to the offset distance X of the three slots applies a resilient restoring force to the heating element coil such that after even repeated firing (or heating) of the heater coil, and that this restorative, resilient force tends to minimize sagging of the heating coil between adjacent insulators 25 thus eliminating or lessening a primary cause of heating element failure, viz., excessive heating coil sag. Further, the coil is positively prevented from moving in axial direction with respect to insulator 25. However, within the broader aspects of this invention, center notch 39 need not be axially offset from the plane C—C of notch ends 35 and 37 and still the heating element coil will be positively restrained against axial movement relative to insulator 25.

As will be further appreciated by those skilled in the art, because only a relatively short segment of each of the convolutions 41, 43, and 45 (see FIG. 5) is in contact with the insulator 25, because substantial air flow can still be directed over a considerable surface area of the segment of the heating element in contact with the insulator, and further because of the heat conduction properties of the insulator, insulator 25 of the present invention prevents or lessens undue temperature buildup in the portion of the heating element in contact with the insulator and thus prolongs service life of heating element 11.

Still further, insulators 25 are so constructed such that they may be readily inserted into support bars 9, positively retained in their installed position, and further such that the completely formed heating element 11 including helical coil runs 13*a*–13*b* and the turnarounds 15*a*–15*e* may be readily and efficiently installed on the insulators, one insulator at a time, without the necessity of having to thread the heating element through the insulators as was heretofore conventional when collar type insulators were used.

More particularly, such insulator 25 (see FIG. 3) is shown to have a pair of notches 47 in its first and second sides 29 and 31 generally coincident with symmetrical axis B—B, the inner bases of these notches being spaced apart from one another by a length, as indicated by dimension L'. Further, as shown in FIG. 1, each of the support bars 9 of frame 3 has a plurality of apertures (e.g., three), as generally indicated by reference characters 49a–49b, one aperture for each insulator 25 to be carried by the support bar. More specifically, each aperture is identical and thus only aperture 49a, as illustrated in FIG. 1, will be described in detail. Specifically, aperture 49a is shown to have a generally circular opening with a pair of diametrically opposed rectangular notches 51a–51b. Further, a stop 53 is optionally provided within the generally circular aperture. It will be understood that the outer extremities of notches 51a, 51b are spaced apart by a dimension W (see FIG. 1) which is somewhat larger than the overall width of insulator 25 between side faces 27 and 29. The width of the slots 51a, 51b is somewhat wider than the thickness T of the insulator such that the insulator may be inserted freely through notches 51a, 51b and into aperture 49. With the insulator inserted approximately halfway through the aperture 49, as it appears in FIG. 2, the insulator may be rotated in counterclockwise direction (as viewed in FIG. 1) such that slots 47 in the sides of the insulator will receive the portion of support bar 9 defining the circular portion of aperture 49 thereby to prevent up and down movement (as viewed in FIGS. 2 and 3) of the insulator relative to the support bar. Upon rotating the insulator in counterclockwise direction approximately 90° to assume the position of the insulator shown in FIG. 1, one face of the insulator will engage stop 53 thereby properly aligning the insulator with respect to the support bars, such that side faces 29 and 31 of the insulator face in the direction of coil axis A—A. It will be appreciated in this manner, insulators 25 may readily be inserted into the frame and secured in place without even the requirement of simple hand-tools. As thus far described, insulator 25 is similar to the insulator described in my co-assigned U.S. Pat. No. 4,472,624.

Referring now to FIGS. 3–5, insulator 25 of the present invention is shown to have a pair of angled outer faces 55 and 57 at each end thereof, spaced outwardly from mounting notches 47, with these angled outer faces converging inwardly. While in the embodiments shown in FIGS. 3–5 the angled outer faces 55 and 57 are spaced outwardly from mounting notches 47, it will be understood that within the broader aspects of this invention, the length of side faces 29 and 31 may vary considerably. Further, in outer end 33 of insulator body 27, center notch 39, as heretofore described, is defined by a pair of tapered center notch faces 59 and 61. Respective outer end tips 63 and 65 are provided between angled outer face 55 and center notch face 59, and between angled outer face 57 and center notch face 61 such that the center notch faces 59 and 61 converge inwardly toward the base of center notch 39, and such that the outer end tips 63 and 65 are radiused. It will be appreciated that the width of the outer end tips 63 and 65 is such that the width of the outer end tips is less than the normal spacing between adjacent convolutions of the coiled heating element. Preferably, the distance between tips 63 and 65 and the ends of notch portions 40 is somewhat greater than half the diameter of the coil.

In accordance with the method of this invention, insulators 25 are installed on heater frame 3 in the manner heretofore described such that the insulators are in their retained positions (as shown in FIG. 1). Runs 13a–13f of heating element 11 are brought into position relative to insulators 25 such that a first convolution 45 of the heating element is generally in register with center notch 39 of a respective insulator 25, and such that adjacent convolutions 41 and 43 have a respective outer end tip 63 or 65 inserted, at least in part, between convolutions 41 and 45, and between convolutions 45 and 43, with the convolutions 41 and 43 engaging their respective angled outer faces 55 and 57. Then, the heating element coil is moved inwardly toward the base of center notch 39 (i.e., toward axis B—B), such that convolution 45 is received within the center notch, and such that angled outer faces 55 and 57 wedgingly spread their respective convolutions 41 and 43 in axial direction along coil axis A—A away from convolution 45 received in center notch 31. As convolutions 41 and 43 move along angled outer faces 55 and 57 and move into register with side notches 35 and 37, the convolutions 41 and 43 snap into place within notches 35 and 37. In this manner, the heating element coil is readily installed on and is positively retained on insulators 25 without special tools and without the necessity of manipulating the coil.

Figure 6:
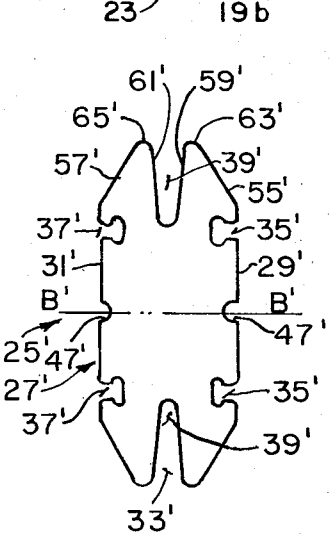
FIG. 6 is a view similar to FIG. 3 of another embodiment of the insulator of the present invention.
Figure 7:
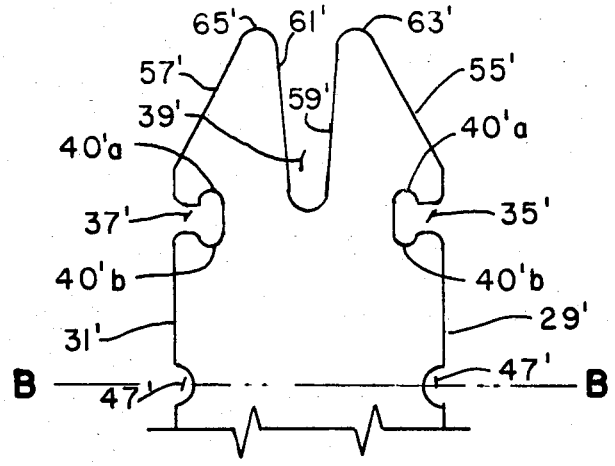
FIG. 7 is an enlarged view of the upper end of FIG. 6.

Referring now to FIGS. 6 and 7, a second embodiment of the insulator of the present invention is indicated in its entirety by reference character 25'. It will be understood that the "primed" reference characters in FIGS. 6 and 7 indicate portions of the unitary insulator 25' having a similar construction and function as portions of insulator 25, as shown in FIGS. 3–5 heretofore explained. Thus, for the sake of brevity, a detailed description of the construction and the function of these corresponding structural features of insulator 25' will not be herein set forth. The chief difference between insulator 25 and insulator 25' resides primarily in the overall length of the insulators (insulator 25' is shown to be somewhat shorter than insulator 25), and in the fact that side notches 35' and 37' have two offset inner notch portions, as indicated at 40'a, 40'b, which extend toward the outer end 33 of the insulator, and toward the center of the insulator. It will be understood that by providing these two inner notch portions 40'a, 40'b, that the heating element convolutions 41 and 43 received in these side slots 35', 37', are prevented from moving in axial direction, both toward and away from the insulator body.

Figure 2:
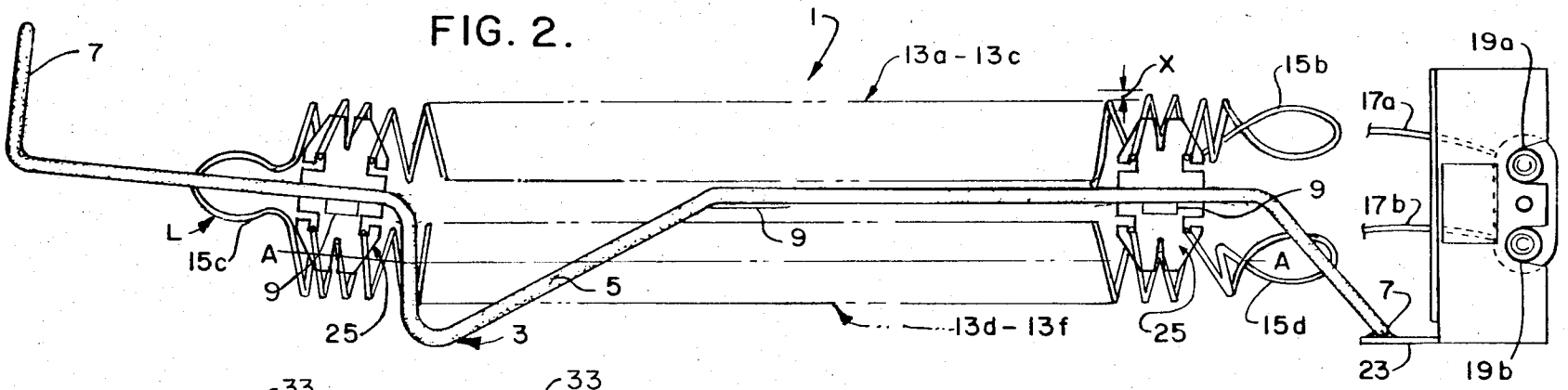
FIG. 2 is a side elevational view of FIG. 1, showing the insulator of FIG. 8.
Figure 8:
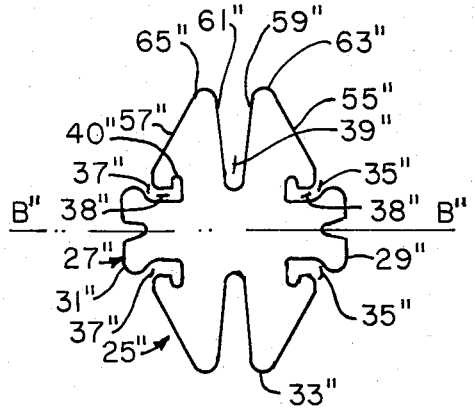
FIG. 8 is a front elevational view of still another embodiment of the insulator of the present invention, this embodiment being illustrated in FIGS. 1 and 2.
Figure 9:
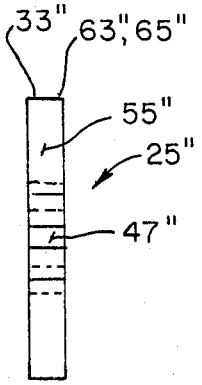
FIG. 9 is a side elevational view of FIG. 8.
Figure 10:
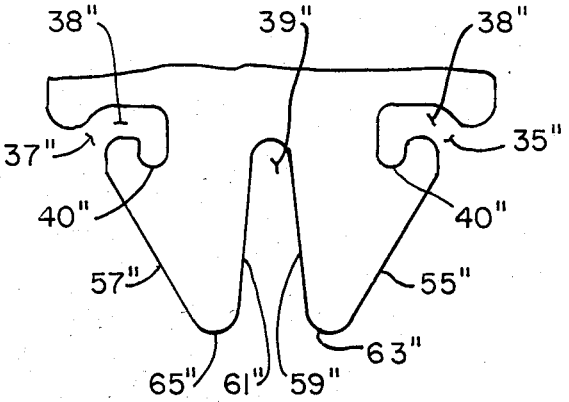
FIG. 10 is an enlarged view of the lower portion of FIG. 8.

Referring now to FIGS. 8–10, still another embodiment of the insulator of the present invention (as shown in FIGS. 1 and 2) is indicated in its entirety by reference character 25". It will be understood that the "double primed" reference characters in FIGS. 8–10 have a corresponding construction and function to corresponding constructions shown in FIGS. 3–7. The primary difference between insulator 25" and insulator 25 and 25' is that the overall length of insulator 25" is considerably shorter such that the first and second sides 27" and 29" are considerably shorter, almost to the point that the first and second sides are nonexistent. Additionally, as shown in FIG. 10, side slots 35" and 37" each have an intermediate portion, as indicated at 38", which leads inwardly and downwardly (i.e., toward axis B"—B", and thence to notch end 40"). This intermediate notch portion 38" aids in holding coil convolutions 41 and 43 in place within side notches 35" and 37". It will also be noted that notches 35" and 37" are, in fact, incorporated in respective angled side faces 55" and 57" rather than in the side faces 27" and 29".

However, installation of insulators 25' and 25'' within frame 3 is essentially identical as above-described in regard to insulator 25. Further, installation of the heating element coil on the insulators 25' and 25'' is essentially the same as heretofore described.

In view of the above, it will be seen that the other objects of this invention are achieved and other advantageous results obtained.

As various changes could be made in the above constructions and methods without departing from the scope of the invention, it is intended that all matter contained in the above description or shown in the accompanying drawing shall be interpreted as illustrative and not in a limiting sense.

What is claimed is:

1. In an electrical resistance heater having an elongate wire heating element of generally helical coil construction, said coil having a coil axis and a plurality of convolutions spaced at substantially equal intervals along said coil axis, said heater having a frame and a plurality of electrical insulators supporting said heating element on said frame, wherein the improvement comprises: each of said insulators having a unitary body of a suitable electrical insulative material, said body having a first and a second side facing in generally opposite direction, means for mounting said insulator body with respect to said frame such that said first and second sides of said insulator body are generally in line with said coil axis, said insulator body having a side notch in each of its said first and second sides, each of said side notches extending generally inwardly toward the center of said insulator body and having in inner end, at least a portion of said first and second sides of said insulator body being substantially planar and spaced outwardly with respect to said frame from said mounting means and angling inwardly so as to constitute a pair of planar, angled outer faces converging toward one another, said insulator body having an outer end between said angled outer faces, said outer end having a pair of inwardly converging, planar center notch faces defining a center notch extending inwardly toward said mounting means, means for wedgingly expanding said coil upon installation of said coil on said insulator, this last said means comprising a pair of body end portions or tips between the outer ends of each of said planar, angled outer faces and the outer end of its adjacent said planar center notch face with the distance between said center notch and each of said tips being less than the axial spacing of said convolutions along said coil axis when said coil is substantially unstretched so as to permit said insulator body and said coil to be assembled by disposing said insulator body relative to said coil with said first and second sides of said insulator body facing in opposite directions with respect to said coil axis, with one convolution of said coil substantially in register with said center notch, and with adjacent convolutions of said coil on opposite sides of said one convolution being disposed for wedging engagement by respective said planar angled outer faces of said insulator body such that said one convolution is received within said center notch and such that each of said tips is disposed between said one convolution and a next adjacent convolution so that said next adjacent convolutions are wedgingly spread outwardly away from said one convolution by engagement with a respective said planar angled outer face until said next adjacent convolutions are in register with and are received in said side notches, and means for positively retaining said coil in position on said insulator including said center notch having a base which is offset relative to said coil axis with respect to a line established by the inner ends of said side notches, and further including each of said side notches having a first or entry portion extending generally inwardly of the insulator from the respective first or second side thereof and a second or end portion at an angle with respect to said entry portion and extending toward said outer end of said insulator thereby defining a retaining shoulder between said entry and end portion of said slot so as to positively prevent said coil convolutions received in said side slots from exiting said side slots.

2. In an electric heater as set forth in claim 1 wherein said pair of angled outer faces converging toward one another have an included angle therebetween ranging between about 30–60 degrees.

3. In an electric heater as set forth in claim 2 wherein said included angle is about 50 degrees.

4. In an electric heater as set forth in claim 1 wherein the included angle between said center notch faces ranges between about 10 and 30 degrees.

5. In an electric heater as set forth in claim 4 wherein said included angle between said center notch faces is about 15 degrees.

6. In an electric heater as set forth in claim 1 further comprising a tip between each of said angled outer faces and a respective adjacent center notch face, and wherein the length of said insulator between said body portion tip and a respective said side notch is greater than one-half of the diameter of said coil.

* * * * *